US006557302B1

(12) United States Patent
Kaps

(10) Patent No.: US 6,557,302 B1
(45) Date of Patent: May 6, 2003

(54) DOG FOR FIXING A WINDOW GLASS ONTO A WINDOW LIFTER

(75) Inventor: Robert Kaps, Coburg (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 09/674,867

(22) PCT Filed: Apr. 17, 1999

(86) PCT No.: PCT/DE99/01270

§ 371 (c)(1),
(2), (4) Date: Nov. 6, 2000

(87) PCT Pub. No.: WO99/57399

PCT Pub. Date: Nov. 11, 1999

(30) Foreign Application Priority Data

May 5, 1998 (DE) ..... 198 19 910

(51) Int. Cl.[7] ..... E05F 11/38
(52) U.S. Cl. ..... 49/375; 49/372
(58) Field of Search ..... 49/375, 358, 372, 49/374; 52/716.5

(56) References Cited

U.S. PATENT DOCUMENTS

| | | | | | |
|---|---|---|---|---|---|
| 72,409 | A | * | 12/1867 | Mason | 403/359.1 |
| 4,475,314 | A | | 10/1984 | Faix et al. | |
| 4,910,917 | A | * | 3/1990 | Brauer | 49/348 |
| 4,991,351 | A | * | 2/1991 | Bertolini | 49/351 |
| 5,243,785 | A | * | 9/1993 | Nieboer et al. | 49/375 |
| 5,502,926 | A | * | 4/1996 | Grace et al. | 49/375 |
| 5,515,651 | A | | 5/1996 | Hofmann et al. | |
| 5,622,005 | A | * | 4/1997 | Ochenski et al. | 49/375 |
| 5,673,515 | A | * | 10/1997 | Weber et al. | 49/352 |
| 5,729,930 | A | * | 3/1998 | Schust et al. | 49/375 |
| 5,778,599 | A | * | 7/1998 | Saito | 49/375 |
| 5,832,667 | A | * | 11/1998 | Buening et al. | 49/212 |
| 6,205,711 | B1 | * | 3/2001 | Klippert | 49/375 |

FOREIGN PATENT DOCUMENTS

| | | |
|---|---|---|
| DE | 28 43 633 | 4/1980 |
| DE | 41 02 941 | 8/1992 |
| DE | 42 18 425 | 12/1993 |
| DE | 44 23 440 | 2/1995 |
| EP | 0 643 188 | 3/1995 |

* cited by examiner

*Primary Examiner*—Gregory J. Strimbu
(74) *Attorney, Agent, or Firm*—Christie, Parker & Hale, LLP

(57) ABSTRACT

A carrier for connecting a window pane to a window lifter including retaining arms which are located to each side of the lower edge of the window pane. At least one of these retaining arms has a recess in which a window bolt can engage to connect the window pane to the carrier. At least the upper part of at least one retaining arm is resilient. One retaining arm has a retaining area formed as a horizontal oblong guide and the other retaining arm has a fixing area which is resiliently attached to the carrier for horizontally urging the window bolt as the bolt moves with respect to the carrier within the horizontal guide.

16 Claims, 11 Drawing Sheets

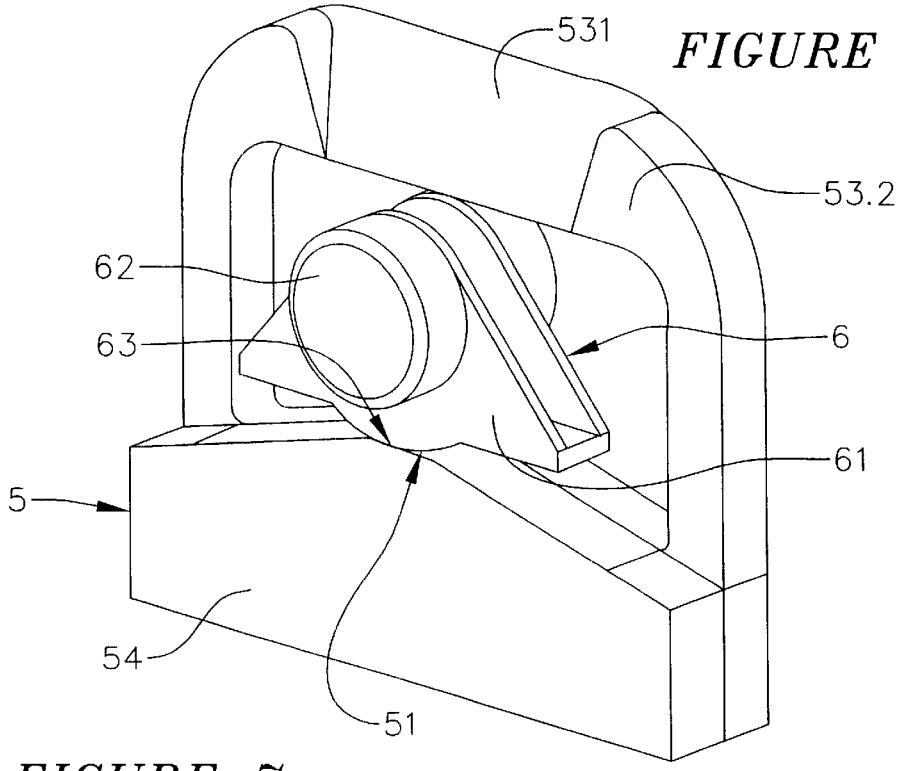
FIGURE 6
FIGURE 7
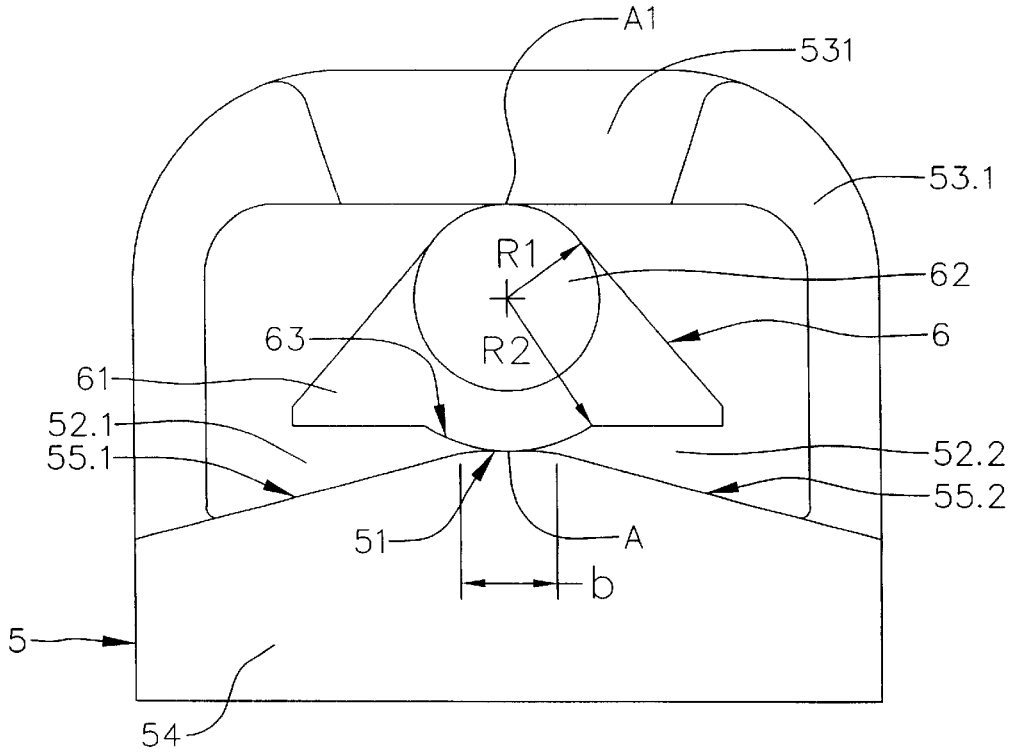

DOG FOR FIXING A WINDOW GLASS ONTO A WINDOW LIFTER

FIELD OF THE INVENTION

The invention relates to a carrier for connecting a window pane to a window lifter comprising retaining arms which are located to both sides of the lower edge of the window pane. At least one of these retaining arms has a recess in which a window bolt can engage in order to lock the window pane. At least the upper part of at least one retaining arm is formed spring elastic and has a guide-in area.

BACKGROUND OF THE INVENTION

From DE 4423 440 A1 a carrier is known for fixing a window pane of a motor vehicle onto the guide rails of a window lifter. This carrier comprises retaining arms which are mounted on each side of the lower area of the window pane. At least one of these retaining arms has a recess in which a connecting element can engage in order to lock the window pane. At least an upper part of at least one retaining arm is formed spring elastic and supports a guide bevel directed towards the lower edge of the pane.

The connecting element for locking the window pane is already connected to the window pane prior to assembly. As connecting elements are used bolts mounted in full-length holes of the pane, elements stuck onto the panes or elements shaped out of the pane.

For assembly the connecting element is inserted into the gap between the retaining arms and engages there in the recesses. The position of the window pane is thereby fixed in this way.

In order to be able to compensate for tolerances in the parallel position of the guide rails or to undertake adjustments, in one embodiment the recesses are formed as horizontally aligned oblong hole guides. Thus the one connecting element can be fixedly mounted in the carrier and the other connecting element can be mounted in this oblong hole guide (loose bearing/fixed bearing system).

Despite these measures the device is not in a position to compensate for the tolerances which can occur between the window pane and the seal during movement of the window pane. The reason for this is that the window pane is fixed by the fixed bearing in its position relative to the vehicle door, that is to the guide of the pane in the vehicle door. In the event of unfavourable tolerance positions there can result high friction forces in the guides or in the seals of the window pane in the vehicle door.

The carrier device further has the drawback that during manufacture of vehicle doors a special carrier of the correct type has to be provided for each angular position between the travel direction of the carrier and the lower edge of the window pane.

SUMMARY OF THE INVENTION

The object of the present invention is to develop a carrier which can be used for different angular positions between the travel direction of the carrier and the lower edge of the window pane and/or is in a position to compensate the position of the window pane in the travel direction (x-direction).

According to one embodiment of the present invention, this is achieved through a retaining area designed as a horizontal oblong hole guide which is associated with one of the retaining arms, while a fastening area mounted horizontally resilient is associated with the other retaining arm.

This solution has the advantage that it is possible to compensate the tolerances both with regard to the parallel alignment of the two guide rails and the parallel alignment between the pane guide on the B-pillar and the guide rail associated with same.

Since one carrier combines both the function of guiding in the vertical direction (z-direction) and the function of resilience in the horizontal direction (x-direction) the structural design of fixing the pane is the same on both carriers of twin-cable window lifters. Thus the carriers can be constructed structurally identical and it is possible to use these also for a single-strand window lifter.

According to another embodiment of the present invention, a contour is formed in the region of the lower edge of the window pane whose cross-section is formed as a segment of a circle wherein the height of the circle segment is fixed in dependence on the angular positions to be covered between the carrier and the window pane edge and the contour rests on a support surface arranged on the carrier and wherein the width of the support surface is measured so that the support point with maximum tolerance deviations in the horizontal direction still rests on this support surface.

This embodiment is suitable for different angular positions of the carrier relative to the window pane. At the same time there is also the possibility of compensating for movement at right angles to the travel direction of the window pane or to the direction of force introduced into the window pane. Thus it is possible to make a universal carrier which is suitable for a variety of uses.

A further advantage is that no component of movement of the operating force appears parallel to the lower edge of the window pane (in the plane of the window).

DESCRIPTION OF THE DRAWINGS

These and other features of the present invention will now be explained in further detail with reference to the specification, claims, and drawings wherein:

FIG. 6 shows a partial perspective view of the carrier according to FIG. 5 without the window pane and front retaining element.

FIG. 7 shows a front view of the carrier shown in FIGS. 5 and 6.

DETAILED DESCRIPTION OF THE INVENTION

Figure 1:
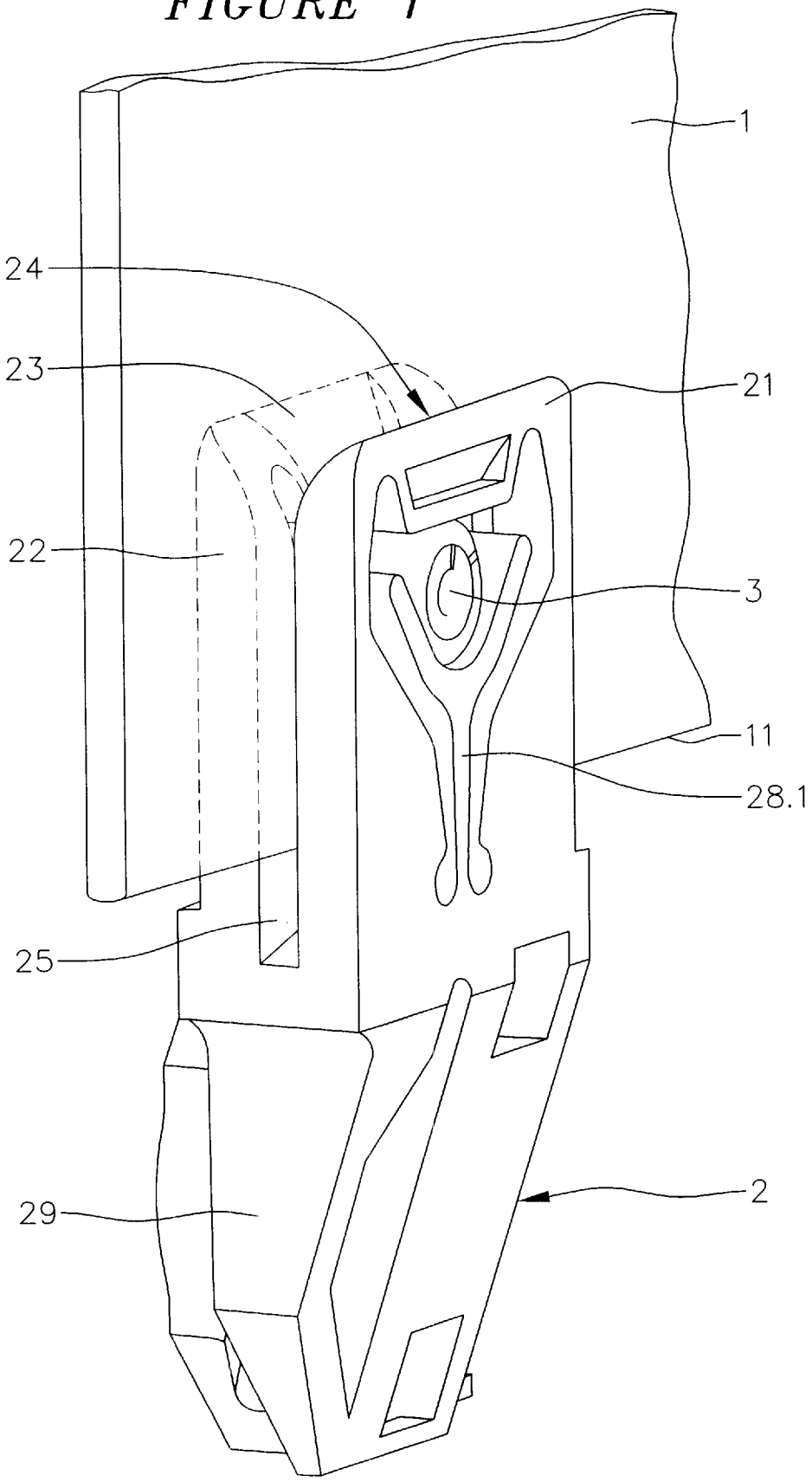
FIG. 1 shows a perspective view of the carrier according to the invention for compensating tolerances in the x-direction with a window pane and window bolt.

The embodiment according to FIG. 1 shows a carrier 2 which is provided with two retaining arms 21, 22. The window pane 1 is held by its lower edge 11 in the gap 25 between the retaining arms 21, 22. A window bolt 3 is inserted as a connecting element into the window pane 1 and is held by the retaining arms 21, 22.

Figure 2:
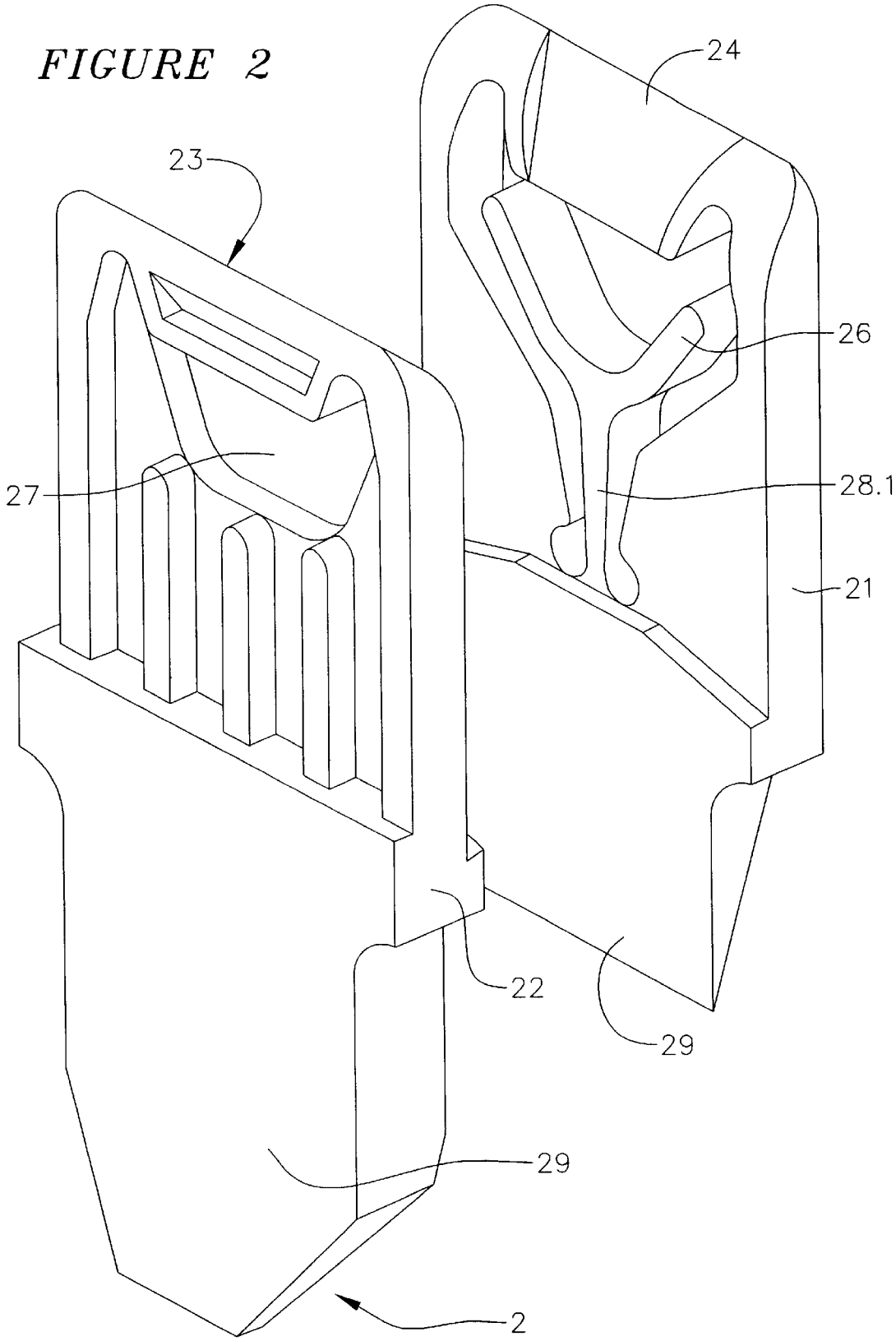
FIG. 2 shows a perspective view of the carrier of FIG. 1 with a separate view of the retaining arms.

As shown in FIG. 2, the two retaining arms have in their upper part a guide bevel 23, 24 to guide the window bolt 3 into its installation position. Both the retaining arm 21 and the retaining arm 22 are formed symmetrical. However the two retaining arms 21, 22 differ significantly from each other with regard to their construction.

Figure 13:
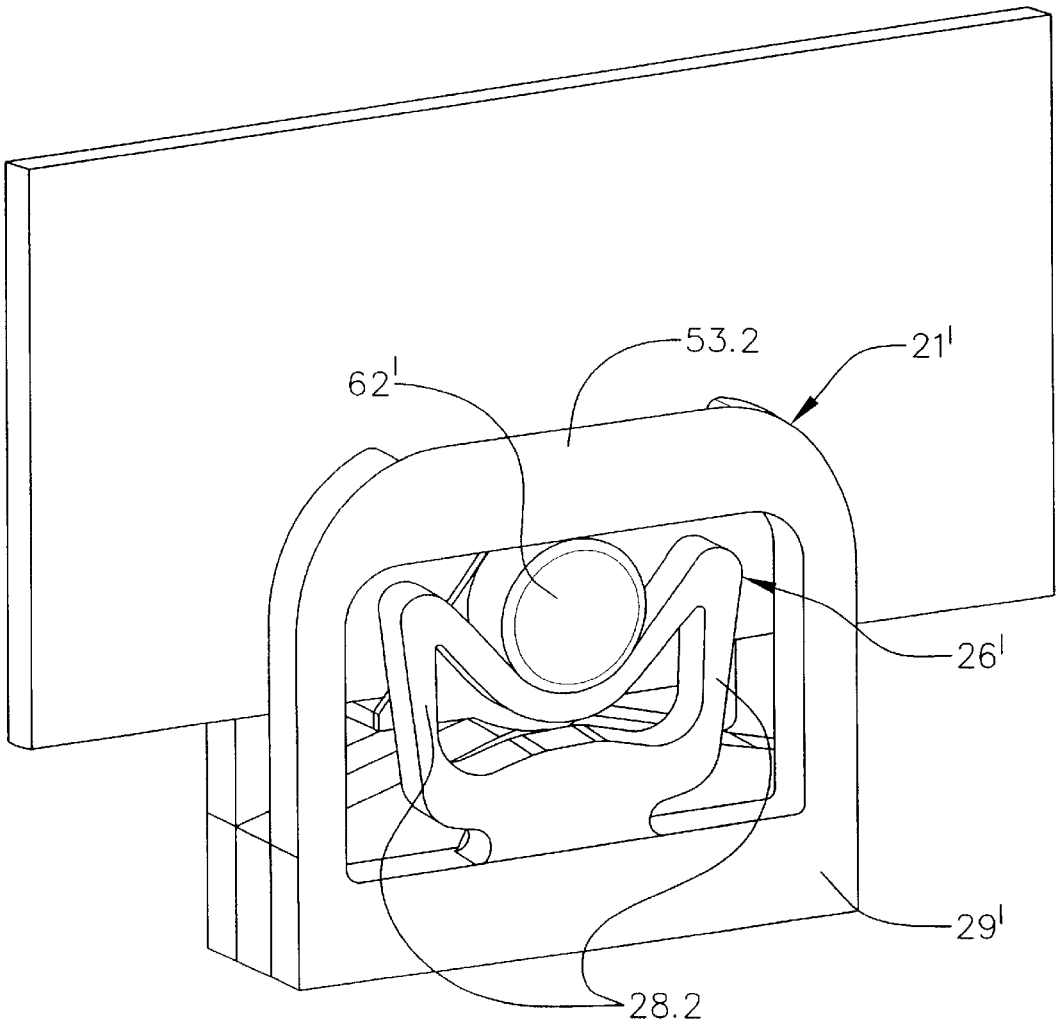
FIG. 13 shows a view of a carrier with tolerance compensation in the x-direction and to compensate different positions relative to the window pane.
Figure 14:
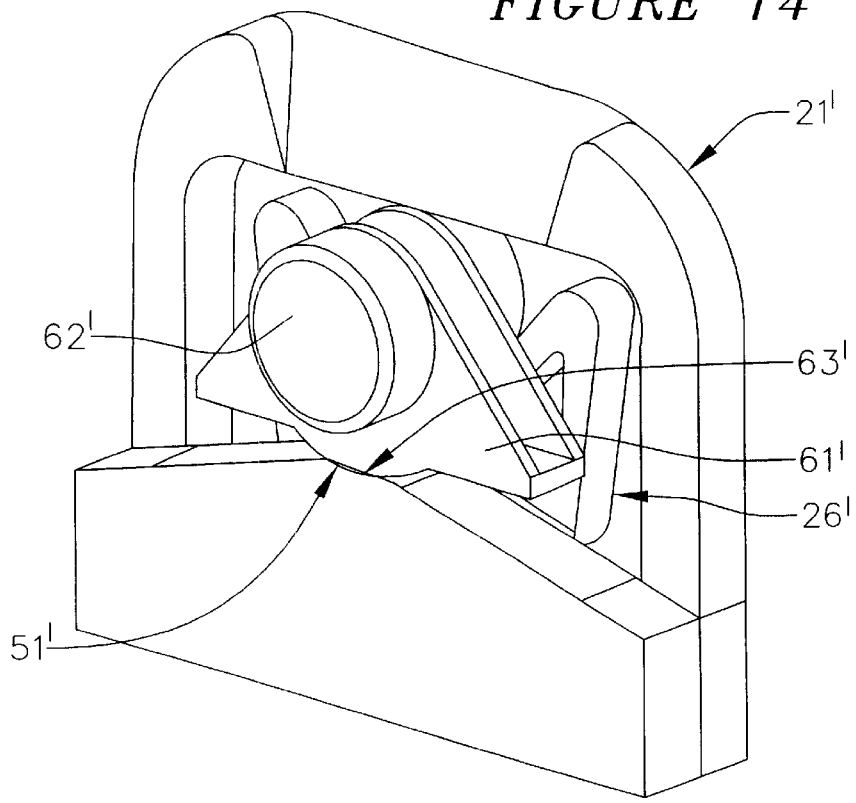
FIG. 14 shows an incomplete view of the carrier according to FIG. 13 without window pane and front retaining element.
Figure 15:
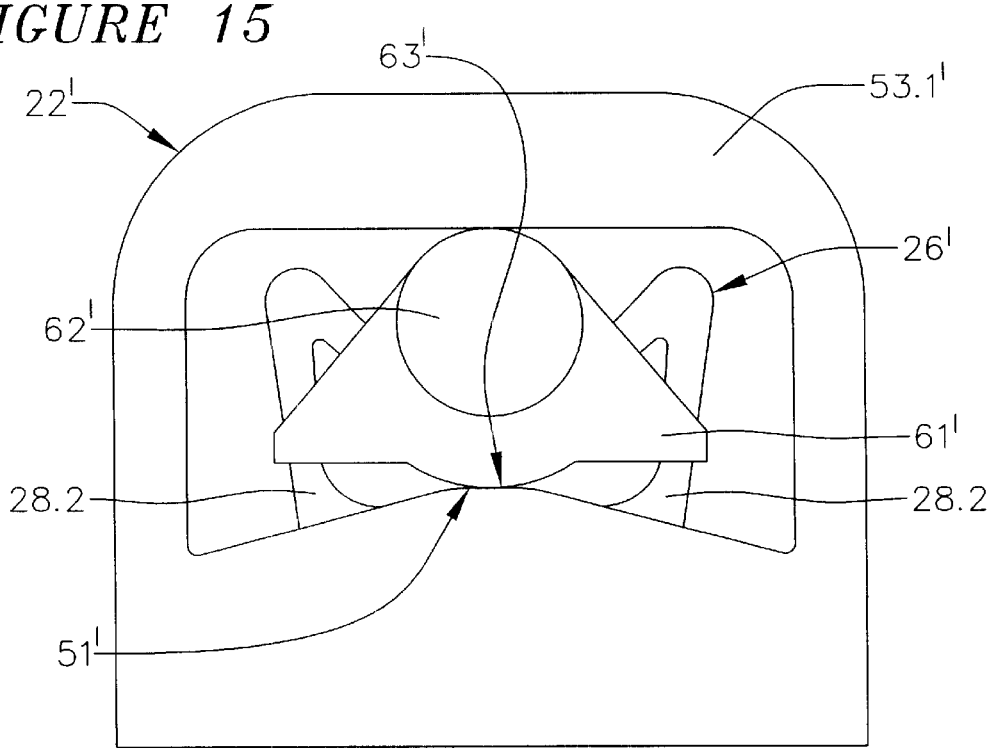
FIG. 15 shows a front view of the carrier according to FIG. 13.

A component part of the retaining arm 21 is a fixing area with a bolt socket 26 which holds the window bolt 3. The bolt socket 26 is resilient in the horizontal x-direction (i.e. in the travel direction). This is achieved by the bolt socket 26 having a V-shaped guide-in area wherein a spring elastic web 28.1 is formed between the v-shaped guide in area and the base body 29 of the carrier 2. The shape of the bolt socket 26 is not restricted to the v-shape. For example, as shown in FIGS. 13 to 15, a bolt socket 26' in the form of an "M" is also possible, wherein the guide-in area is thereby connected on each side through arms 28.2 to the base body 29', wherein both the guide-in area and/or the side arms 28.2 are resilient.

The retaining arm 22 has a retaining area in the form of an oblong hole 27 extending in the x-direction (see FIG. 2) and holding the window bolt in its installation position.

On inserting the window pane 1, the window bolt 3 passes through the guide-in bevels 23, 24 into the installation position. The oblong hole 27 of the retaining arm 22 allows displacement in the x-direction but can fully take up the force component acting in the vertical z-direction. The retaining arm 22 is therefore mounted directly on the side facing the guide rail so that the withdrawal forces can be safely transferred.

The bolt socket 26 of the retaining arm 21 is used to secure the position in the x-direction. Although the position of the window bolt 3 is thereby fixed, the spring action in the x-direction can reliably compensate the installation tolerances.

Figures 3A, 3B, 3C:
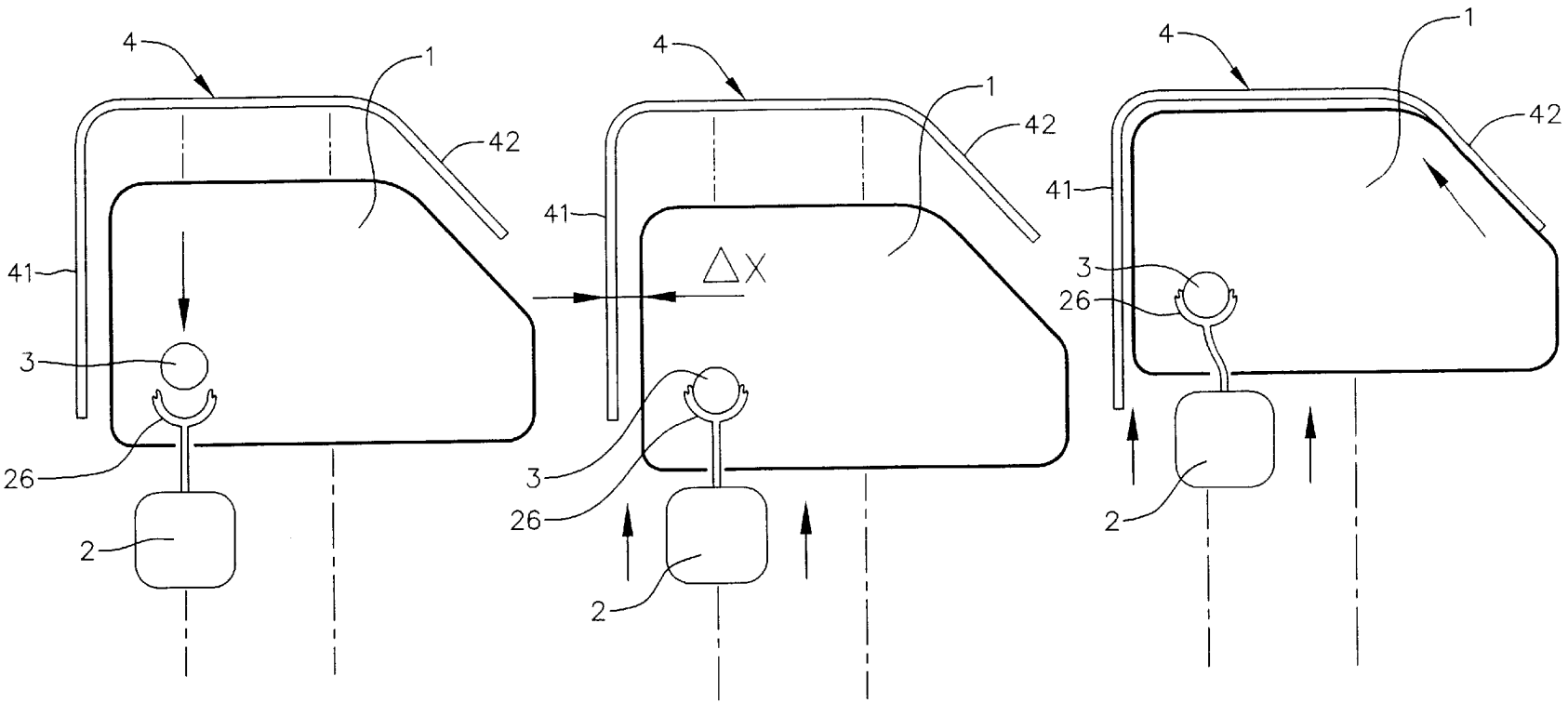
FIG. 3*a* shows the position of the window pane relative to the seal of a vehicle door prior to installation of the carrier.
FIG. 3*b* shows the window pane connected to the carrier during installation of the carrier.
FIG. 3*c* shows that when the window pane is moved upwards it is pressed by the inclined sealing section into the sealing section.

FIGS. 3*a*, 3*b*, and 3*c* show using the present carrier for compensating tolerances during installation of the window pane 1. FIG. 3*a* shows the position of the window pane 1 relative to the seal 4 of a vehicle door (not shown) prior to installation. The installation tolerances are fixed so that the window pane 1 is spaced from or just touches the sealing section 41 located on the B-pillar of the vehicle, so that the window pane 1 can be fitted free of tension.

FIG. 3*b* shows the window pane 1 connected to the carrier 2. It can be seen that a distance $\Delta Xx$ is present between the window pane 1 and the sealing section 4. When the window pane is moved upwards, as shown in FIG. 3*c*, it is pressed by the inclined sealing section 42 into the sealing section 41 and compensates any possible spacing which may exist there.

Figure 4C:
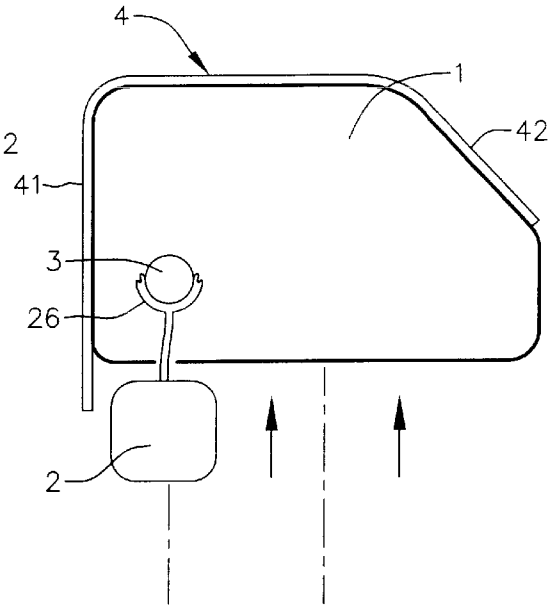
FIG. 4*c* shows the window pane in its upward position during installation of the carrier.
Figure 4B:
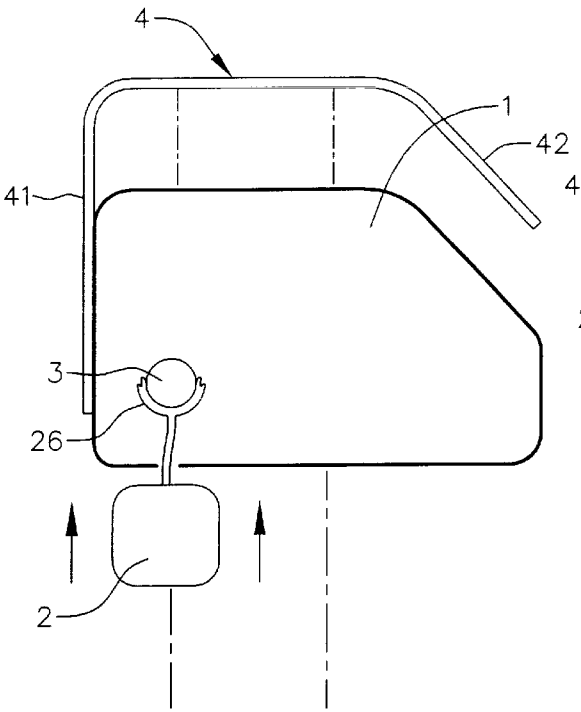
FIG. 4*b* shows the window pane connected to the carrier during installation of the carrier, wherein the window pane contacts the seal when moving upwards.
Figure 4A:
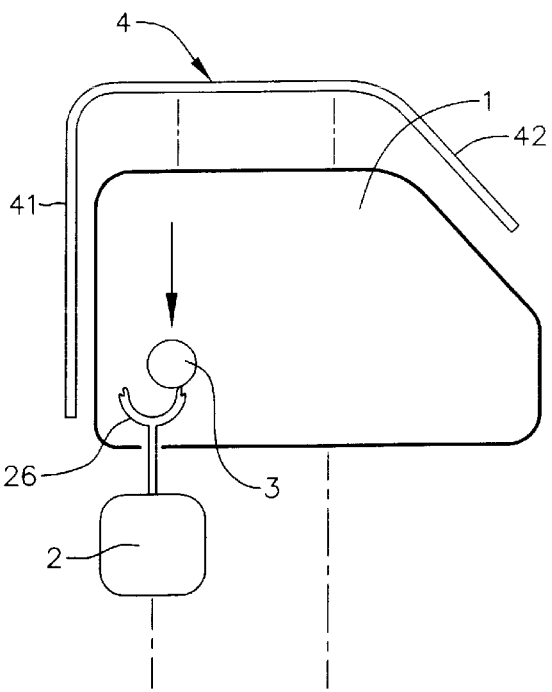
FIG. 4*a* shows the position of the window pane relative to the seal of the vehicle door prior to installation of the carrier.

A different installation concept is shown in FIGS. 4*a* to 4*c*. Here the window pane is installed under compression in relation to the sealing section 41 on the B-pillar (see here FIG. 4*b*) so that the window pane 1 when moving upwards always has contact with the sealing section 41 and glides in the direction of the sealing section 42 on the A-pillar. The tolerances for the compensation movement of the carrier must be selected so that the window pane glides into an end position in the direction of the A-pillar, showing essentially no compression of the seal portion 41 at the B-pillar (FIG. 4*c*).

Figure 5:
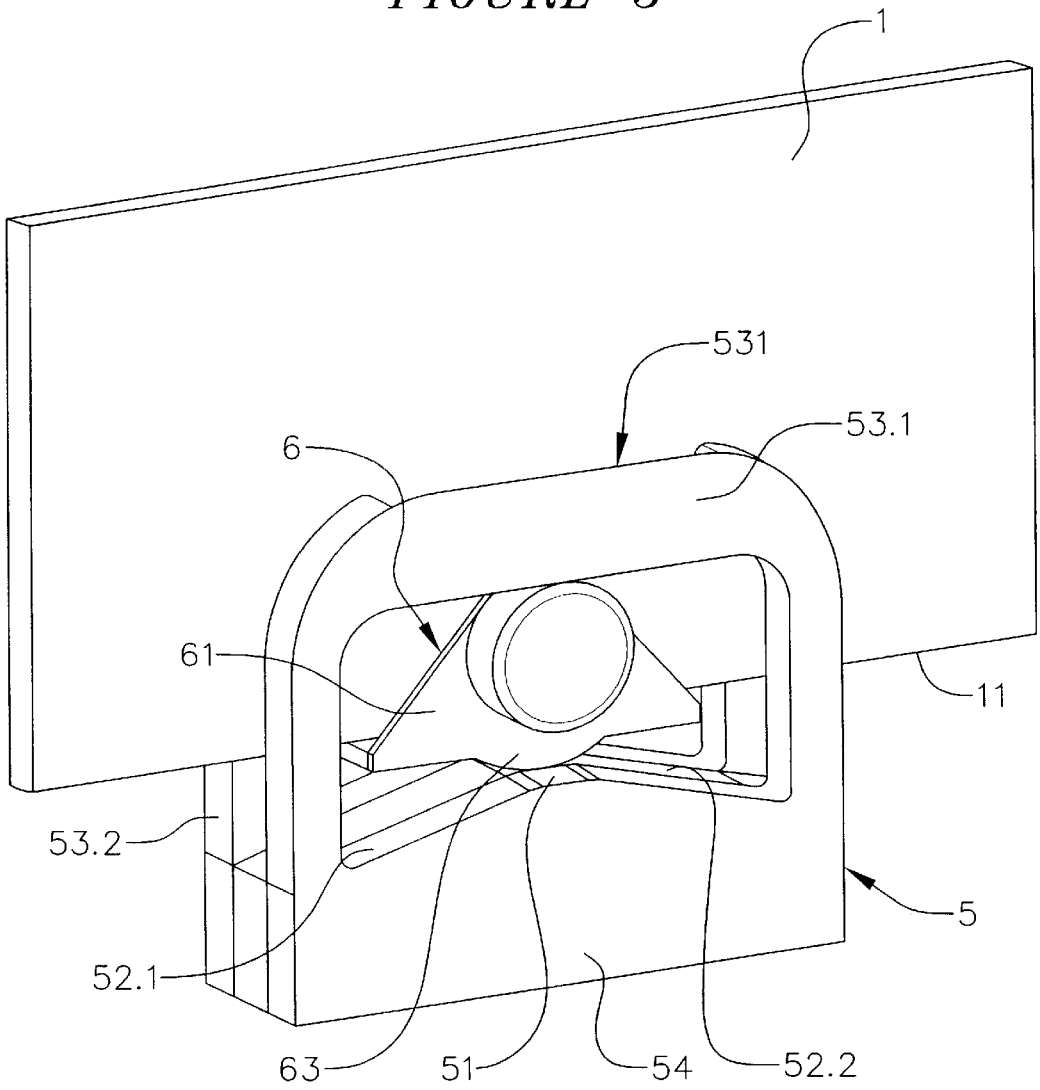
FIG. 5 shows a perspective view of the carrier for compensating different positions of the window pane.

In FIGS. 5, 6 and 7 an alternative carrier 5 is shown which can be used for a cable or tubular window lifter and offers the ability to be used for different positions relative to the lower edge 11 of the window pane. For clarity the yoke 53.1 at the front and the window pane 1 have been omitted from the view shown in FIG. 6.

The carrier 5 comprises a carrier base body 54 which is provided with yokes 53.1, 53. 2 which correspond to the retaining arms 21, 22 described in FIGS. 1 and 2. The yokes 53.1, 53.2 have a guide bevel 531 for guiding in a window bolt 62.

As shown in FIG. 5, connecting part 6 associated with the window pane 1 is fitted between the base body 54 of the carrier and the yokes 53.1, 53.2. The connecting part 6 can be seen more clearly from FIG. 6. The connecting part 6 comprises a base 61, which is mounted against each side of the window pane 1. Circular round window bolts 62 are formed on each side on the base 61. The lower part of the base 61 supports a contour 63 which has the shape of a segment of a circle.

FIG. 7 shows the geometric conditions which are to be observed when designing the carrier 5. The contour 63 rests in the support point A on a support surface 51 which is mounted on the base body 54 of the carrier. The width b of the support surface 51 must be dimensioned so that with maximum displacement of the support point A in the x-direction always rests on the support surface 51.

It is necessary for the radius R1 of the connecting part 6 and the radius R2 of the contour 63 to have the same center M. The reason for this is that as a result of the functioning conditions the distance between the upper contact bearing point A1 of the window bolt 62 on the yoke 53.1, 53.2 and the support point A on the support surface 51 must always be the same with each angular position between the carrier 5 and the window pane 1.

Next to the support point A in the x-direction, clearances 52.1, 52.2 are provided to ensure that with different angular positions of the connecting part 6 relative to the support surface 51 the lower edge of the connecting part and/or the lower edge 11 of the window pane 1 do not sit on the base body 54 of the carrier. These clearances are produced by the areas adjoining the support surface having a falling contour 55.1, 55.2.

The connecting part 6 is mounted free of play between the yokes 53.1, 53.2 of the carrier 5 and the support surface 51.

Figure 8:
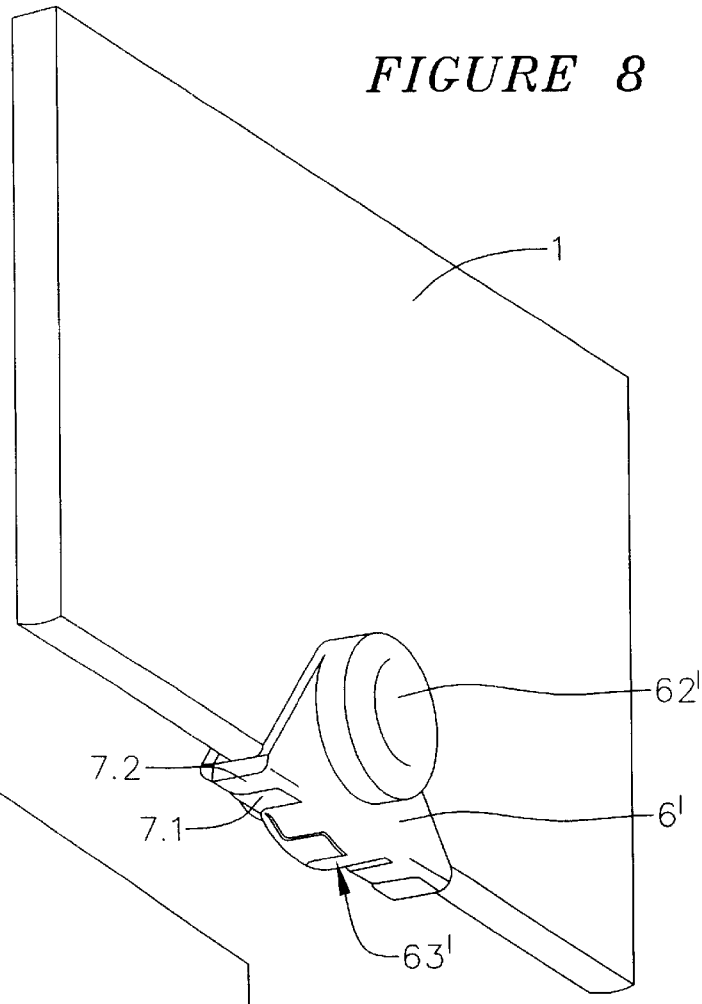
FIG. 8 shows a view of a connecting part with cogs in the assembled state with the window pane.
Figure 9:
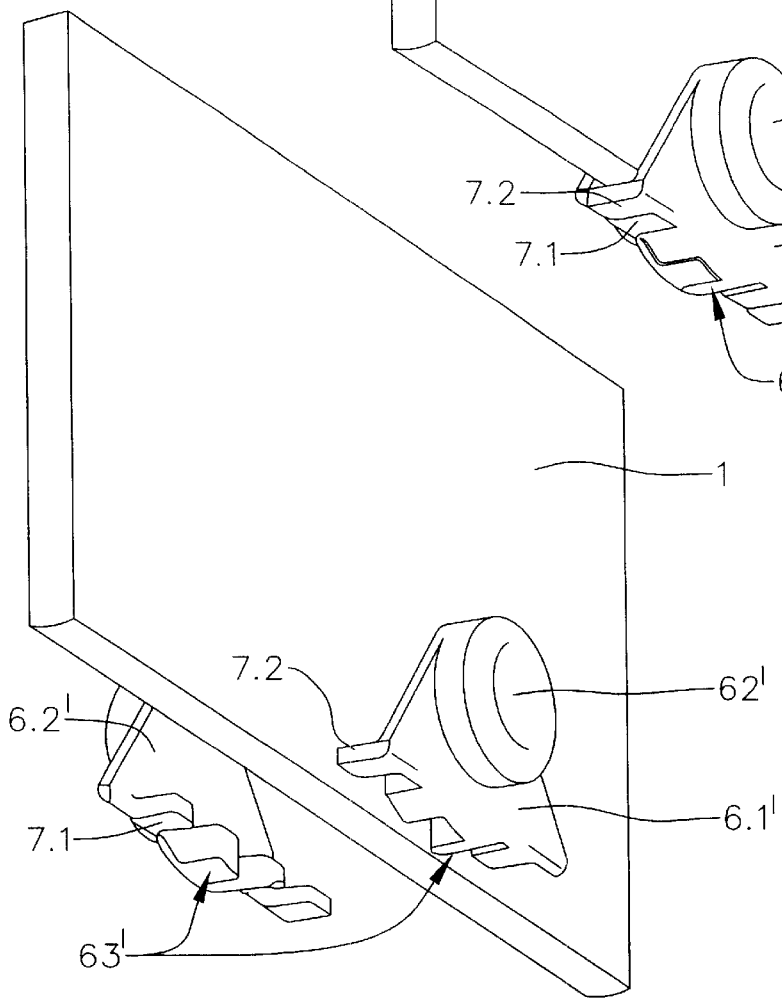
FIG. 9 shows a view of the connecting part prior to assembly.

FIGS. 8 and 9 show a further preferred embodiment of the connecting part, wherein the connecting part 6' is designed in two parts. The connection between the individual parts 6.1', 6.2' is made by positive locking elements. In this case there are rectangular cogs 7.1, 7.2. The contour 63' is shaped in the area of these rectangular cogs. The two individual parts 6.1', 6.2' are placed on each side of the window pane 1. When bringing together the individual parts 6.1', 6.2' the rectangular cogs 7.1, 7.2 ensure that they are accurately positioned. Tolerances with regard to the thickness of the window pane 1 are compensated so that the adhesive surfaces can be contacted over the entire surface area.

Figure 10:
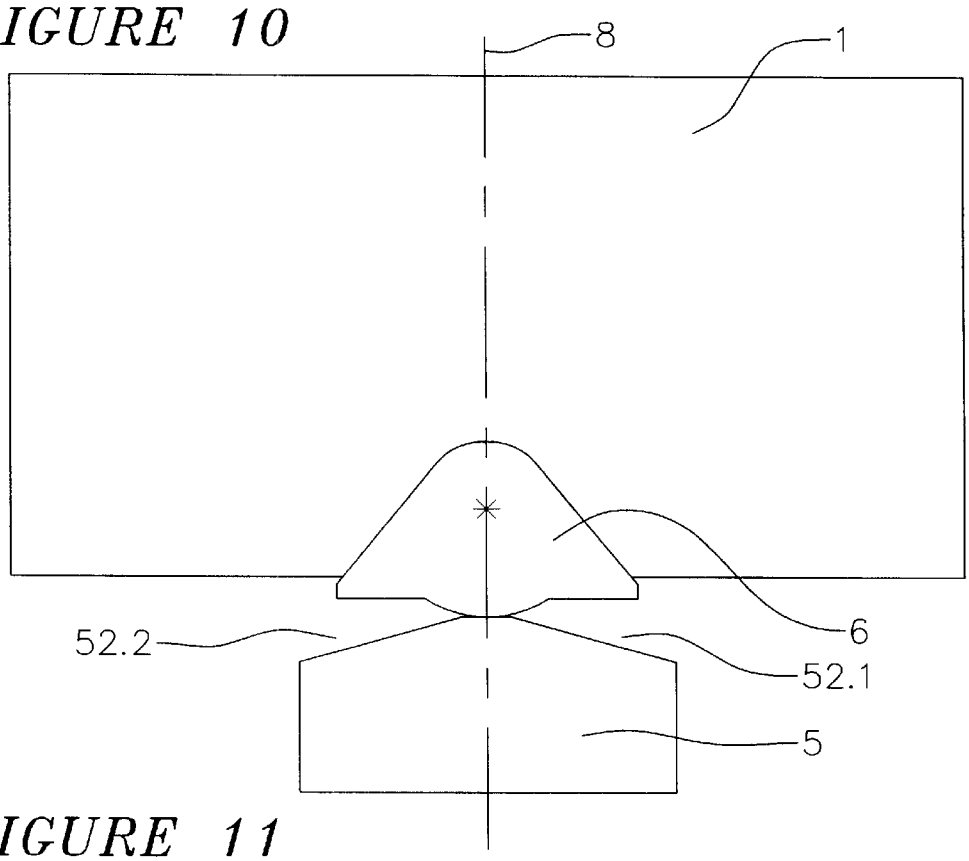
FIG. 10 shows a diagrammatic view of the position of the carrier relative to the guide rails.
Figure 11:
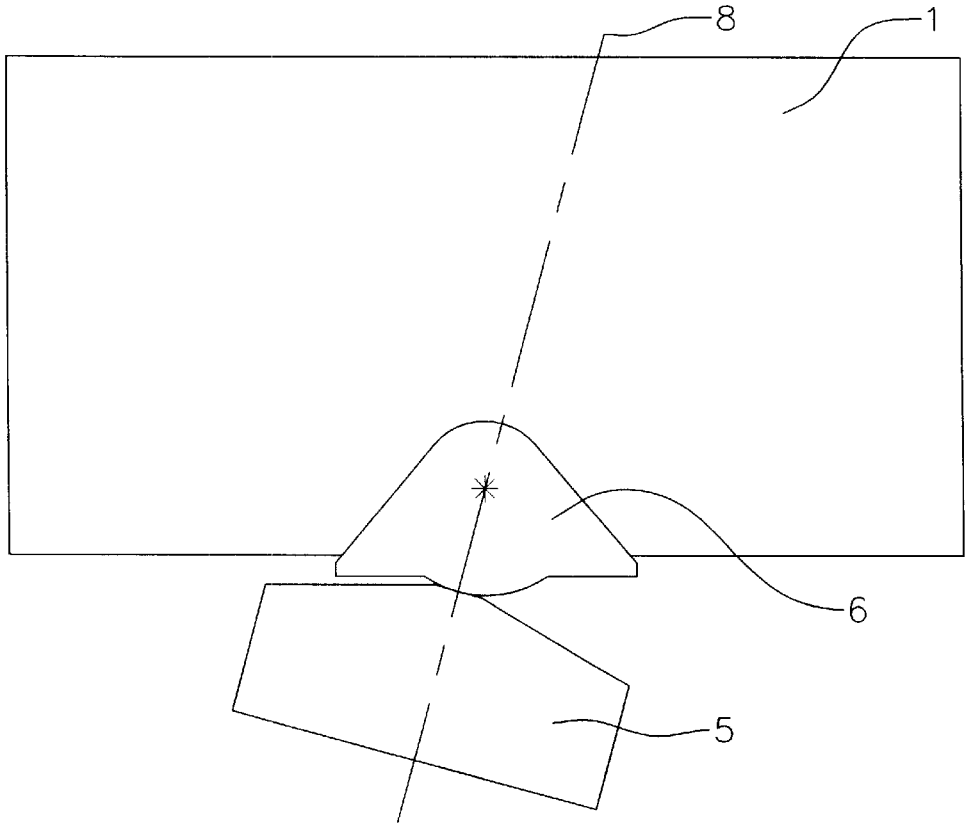
FIG. 11 shows the diagrammatic view of FIG. 10 having an alternate position of the carrier relative to the guide rails.
Figure 12:
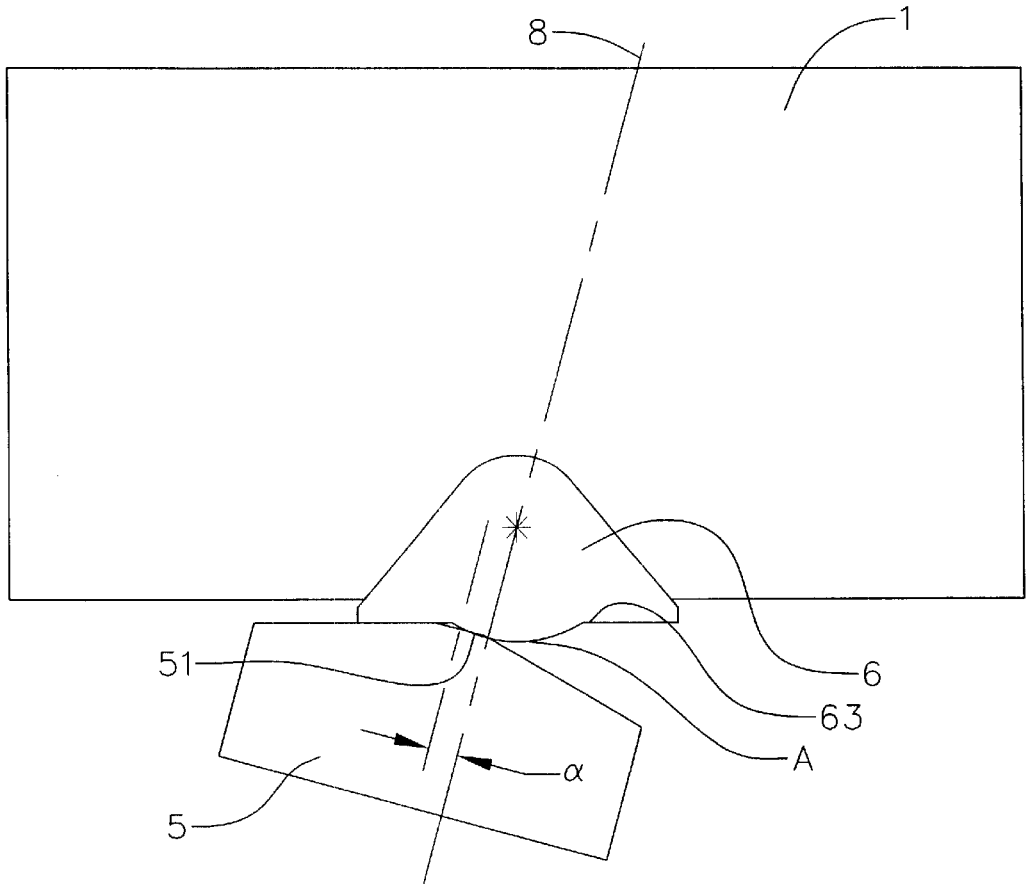
FIG. 12 shows the diagrammatic view of FIG. 10 where the position of the guide rails differ from each other.

FIGS. 10 to 12 show some installation positions of the carrier 5 according to the present invention. For clarity the carrier 5 is only shown diagrammatically. As can be seen from the drawings, the carrier 5 slides on the guide rails 8 which are shown in the drawings by dotted lines. FIGS. 10 and 11 show that the angle of the guide rail 8 relative to the carrier 5 can vary depending on the installation situation, without impairing the function of the carrier 5.

In FIG. 12 a case is shown where the positions of the guide rails 8 differ from each other with regard to the proposed parallel alignment and/or with regard to the spacing from each other. It can be seen that a displacement of the support point A on the support surface 51 is possible by an amount a so that tolerances can be compensated in the x-direction. The extent of the possible displacement depends on the width of the support surface 51 and the geometry of the contour 63.

A further embodiment of the present invention is apparent from FIGS. 13 to 15. Here the features of the embodiment described with respect to FIGS. 1 and 2 are combined with the features of the embodiment described with respect to FIGS. 5 to 7. The retaining arms 21', 22' are designed so that a bolt socket 26' is located to a retaining arm 21' as a horizontally resilient fastening area which secures a position of the window bolt 62' in the x-direction but allows a movement of the window bolt 62' or base body 61' against the spring force of the bolt socket 26'. The yoke 53.2 secures the position of the window bolt 62' in the z-direction. The other retaining arm 22' is associated with a retaining area which is formed by the yoke 53.1' and holds the window bolt 62' in the z-direction. The contour 63' thereby rests on the support surface 51' as described with respect to the other embodiments of the present invention. This carrier is in a position both to allow a compensation in the x-direction and to produce different positions of the carrier relative to the window pane.

The present invention is not restricted to the embodiments described above. For example, the shape of the connecting part 6 is not bound to the shape illustrated and described. It is also possible to mach the contour 63 directly to the lower edge 11 of the window pane 1, to work the contour 63 out from same or to stick on the contour 63. The window bolt can then be mounted or likewise formed in a window pane hole in the window pane 1. Further, the shape of the support surface 51 need not be formed as a flat surface and can be shaped trough-like.

What is claimed is:

1. A carrier for connecting a window pane to a window lifter, the carrier comprising first and second retaining arms which are on opposing sides of a lower edge of the window pane, wherein at least one of the first and second retaining arms has a recess into which a window bolt attached to the window pane can engage in order to connect the window pane to said carrier and wherein at least an upper part of at least one of the first and second retaining arms is resilient, wherein the first retaining arm has a retaining area comprising a horizontal guide for allowing the window bolt to move horizontally with respect to said carrier and the second retaining arm has a fastening structure for holding the window bolt with respect to the carrier, the horizontal guide and the fastening structure are aligned with each other to cooperatively engage the window bolt, wherein the fastening structure is resiliently attached to the carrier for horizontally urging the window bolt as the bolt moves with respect to the carrier within the horizontal guide.

2. The carrier according to claim 1 wherein each of the horizontal guide and the fastening structure are symmetrical relative to a vertical longitudinal axis thereof.

3. The carrier according to claim 1 or 2 wherein the fastening structure has a V-shaped guide-in area for receiving the window bolt.

4. The carrier according to claim 3 further comprising a base body, wherein the V-shaped guide-in area and the base body are connected together resiliently through a web.

5. The carrier according to claim 4 wherein the web comprises a pair of arms connecting the V-shaped guide-in area to the base body, wherein at least one of the V-shaped guide-in area and the pair of arms is resilient.

6. The carrier according to claim 1, wherein one of the lower edge of the window pane and a lower edge of a connecting part located below the lower edge of the window pane, has a contour whose cross-section lying parallel to a plane of the window pane is formed as a segment of a circle, and the contour is supported on a support surface on the carrier.

7. The carrier according to claim 6 wherein the support surface is flat.

8. The carrier according to claim 6 or 7 wherein the carrier includes two surfaces adjoining the support surface which slope downwardly away from the support surface such that the lower edge of the one of the window pane and the connecting part avoids contacting the two surfaces of the carrier adjoining the support surface during angular deviations of the lower edge.

9. The carrier according to claim 6 wherein the connecting part is a component part of the window bolt and can be fixed to the lower edge of the window pane.

10. The carrier according to claim 9 wherein the window bolt comprises molded circular round portions having a center which coincides with a center of the contour.

11. The carrier according to claim 10 wherein the window bolt is mounted in a window pane hole.

12. The carrier according to claim 9 wherein the retaining arms are formed as yokes on each side of the window pane wherein the connecting part is mounted free of play between the support surface and the yokes.

13. The carrier according claim 9 wherein the connecting part is formed in two parts, wherein each part includes a positive-locking element which ensures accurate positioning of the two parts with respect to each other when the two parts are brought together.

14. The carrier according to claim 13 wherein each of the positive locking elements is formed as a rectangular cog.

15. The carrier according to claim 6 wherein the contour is molded on the lower edge of the window pane.

16. The carrier according to claim 6 wherein a radius of the segment of the circle is determined by a maximum allowable angular position of the carrier with respect to the lower edge of the one of the window pane and the connecting part.

* * * * *